United States Patent [19]

Pomento

[11] Patent Number: 4,854,104

[45] Date of Patent: Aug. 8, 1989

[54] ROOF TRUSS ASSEMBLY

[76] Inventor: Patrick G. Pomento, 802 W. Embargo St., Rome, N.Y. 13440

[21] Appl. No.: 259,170

[22] Filed: Oct. 18, 1988

[51] Int. Cl.[4] ..... E04B 1/343; E04C 3/00

[52] U.S. Cl. ..... 52/639; 52/642; 52/643

[58] Field of Search ..... 52/642, 639, 643, 293, 52/93

[56] References Cited

U.S. PATENT DOCUMENTS

| | | | |
|---|---|---|---|
| 2,796,642 | 6/1957 | Woodworth | 52/93 X |
| 3,019,491 | 0/1962 | Troutner | 52/474 X |
| 3,157,251 | 11/1964 | Rasch | 52/643 X |
| 3,172,507 | 3/1965 | Blyveis | 52/643 X |
| 3,184,012 | 5/1965 | Fujishima et al. | 52/293 X |
| 3,191,238 | 6/1965 | Olson | 52/93 X |
| 3,346,999 | 10/1967 | Johnson . | |
| 3,381,985 | 5/1968 | Anttila . | |
| 3,861,109 | 1/1975 | Hunt et al. . | |
| 4,201,021 | 5/1980 | Aldag et al. | 52/93 |
| 4,228,633 | 10/1986 | Geffe . | |
| 4,317,316 | 3/1982 | Atwood et al. | 52/93 |
| 4,387,546 | 6/1983 | Kurita et al. . | |
| 4,483,117 | 0/1984 | Underhill et al. | 52/639 X |
| 4,616,452 | 0/1986 | Lemerre | 52/71 X |
| 4,773,192 | 9/1988 | Andrews | 52/639 X |

FOREIGN PATENT DOCUMENTS

| | | | |
|---|---|---|---|
| 247390 | 3/1947 | Switzerland | 52/642 |

*Primary Examiner*—Carl D. Friedman
*Assistant Examiner*—Lan Mai
*Attorney, Agent, or Firm*—Wall and Roehrig

[57] ABSTRACT

A wooden truss member including a vertically disposed column section and an upwardly pitched roof beam section angularly disposed from the top of the column section to form a corner therebetween, each section including a hollow frame that is covered by side panels. The two sections are joined at the corner by means of an elongated flange. Plywood panels are used to cover each of the section frames and are arranged so that the grain of each panel runs along the length of the frame section. Special corner panels are mounted between the sections to enclose the corner region therebetween. The grain of the corner panels is arranged to run perpendicular to the corner flanges.

14 Claims, 3 Drawing Sheets

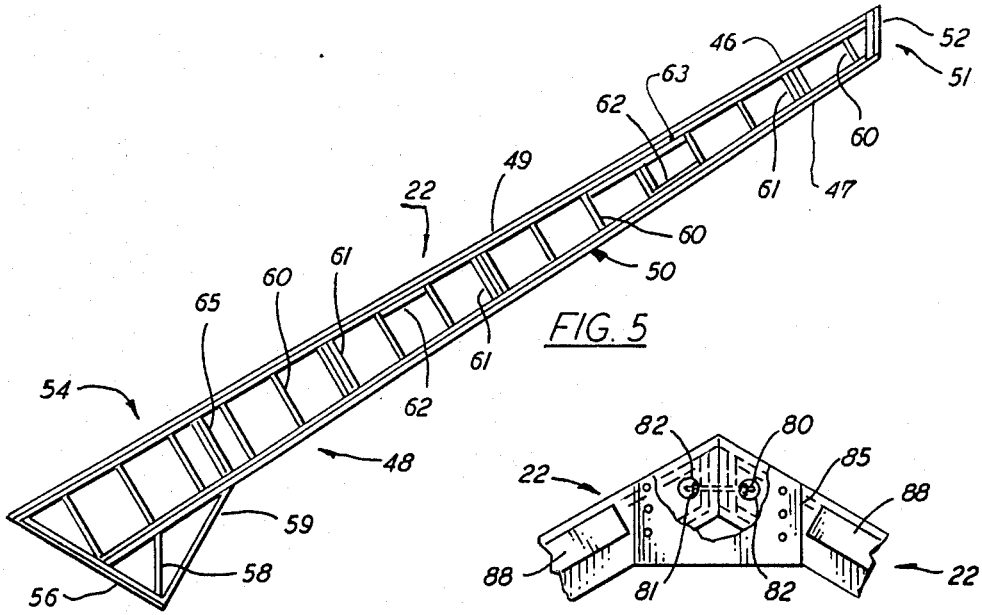
FIG. 5
FIG. 9
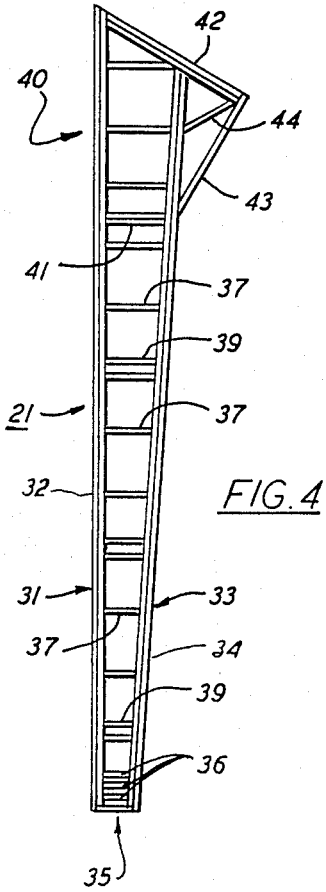
FIG. 4
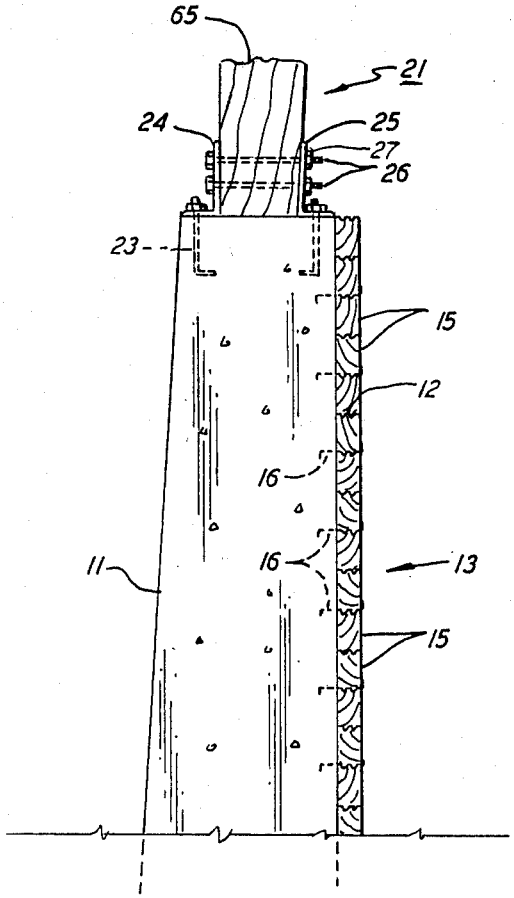
FIG. 3

71
71
68

87
51
46
65
47
65
38
22
60
55
68
65

58
57
69
53
40
43
44
37
65
38
65
21
11
38
65
11
35
75

65
65
21
65
65
31

93
90
87
49
90
91
92
92
86
86
50
65
65
21

ROOF TRUSS ASSEMBLY

BACKGROUND OF THE INVENTION

This invention relates to a wooden roof truss and, in particular, to a wooden roof truss having a box frame construction in which readily available standard size lumber and plywood sheeting is utilized.

Johnson, in U.S. Pat. No. 3,346,999, discloses a wooden roof truss having a box frame construction. The truss is made up of three main sections including a vertical column section that is joined to a roof beam section by means of an elongated splice section. The splice section is placed at the same pitch angle as the roof beam and, in assembly, forms an extension of the roof beam. Each of the three sections contain spaced apart chords that form the end walls of the section and enclosing sheeting which forms the sidewalls of each section. Internal ribs are used to join the chords and thus provide additional strength to the structure. The column section of the truss contains a knee joint having a cylindrical compression block situated at the inside of the joint from which a series of studs radiate. Although the joint is relatively strong, most of the stress produced by loads are taken up by the elongated splice section, and in particular, by the joints between the adjacent column and roof beam sections. If the splice is not securely joined to the other two sections, high localized stress can build up in this critical region which can lead to failure of the truss.

It should be further noted that the three sections of the Johnson truss are co-joined at the time of erection by means of bolts. In this particular design, where the splice section is hung between the roof beam and column sections, the bolts are forced to carry at least a portion of the truss loading. The bolts therefore represent a weak link in the overall structure and thus limit the load carrying capacity of the frame. It should be further noted that the bolts can be easily bent or otherwise deformed if the frame twists or turns as it is being lifted into place at the time of erection.

Underhill, in U.S. Pat. No. 4,483,117, discloses a three part pre-fabricated truss that contains a top or peak section and two identical side sections which are nailed or bolted together in assembly. The sections are fabricated from wooden studs. The entire assembly is thus only as strong as the weakest stud section. Although the truss can be fabricated easily from standard size pieces of lumber, the overall span of the truss is limited as is its load carrying capacity.

Geffe, in U.S. Pat. No. 4,228,631, and Hunt et al., in U.S. Pat. No. 3,861,109, both describe composite wooden joists or beams which are suitable for supporting flooring or the like. Neither of these patents, however, are involved with roof trusses and it would not be possible to construct a roof truss using the teachings contained within these two patents.

SUMMARY OF THE INVENTION

It is therefore an object of the present invention to provide a roof truss having a vertical column section and a pitched roof beam section that are prefabricated at the factory and then brought together at the time of erection to form a composite structure whereby induced loads are not permitted to become localized within specific areas of the structure.

A further object of the present invention is to provide a composite roof truss made of wood that can be accurately prefabricated within a factory using standard size lumber and sheeting.

Yet another object of the present invention is to provide a wooden roof truss member having a box frame construction that does not require bolts or other types of mechanical fasteners to resist induced loads and stresses.

Another object of the present invention is to provide a prefabricated roof truss that can be manufactured in two separate sections within a factory under close tolerances using adhesive to close the component joints.

These and other objects of the present invention are attained by means of a wooden truss member that includes two factory made sections that are joined together at an erection site to create a composite structure capable of withstanding high external loads. Each section includes a box-like frame that is closed by plywood sheets. An elongated flange is located at the corner joint between the sections which provides for additional strength in the critical corner region.

BRIEF DESCRIPTION OF THE DRAWINGS

For a better understanding of these and other objects of the present invention, reference is herein made to the following detailed description of the invention which is to be read in conjunction with the following drawings, wherein:

FIG. 3 is a side elevation in partial section showing the column section of a truss member anchored to a support pier.

FIG. 4 is a side elevation of the column section of the present truss member with the side panels removed to show the structural frame of the section;

FIG. 5 is also a side elevation of the upwardly pitched roof beam section of the present truss member with the side panels removed to show the structural frame of the panel;

FIG. 9 is a partial side elevation showing the crown section of one truss member being joined to the crow section of a second truss member to complete a roof support assembly;

DESCRIPTION OF THE INVENTION

Figure 1:
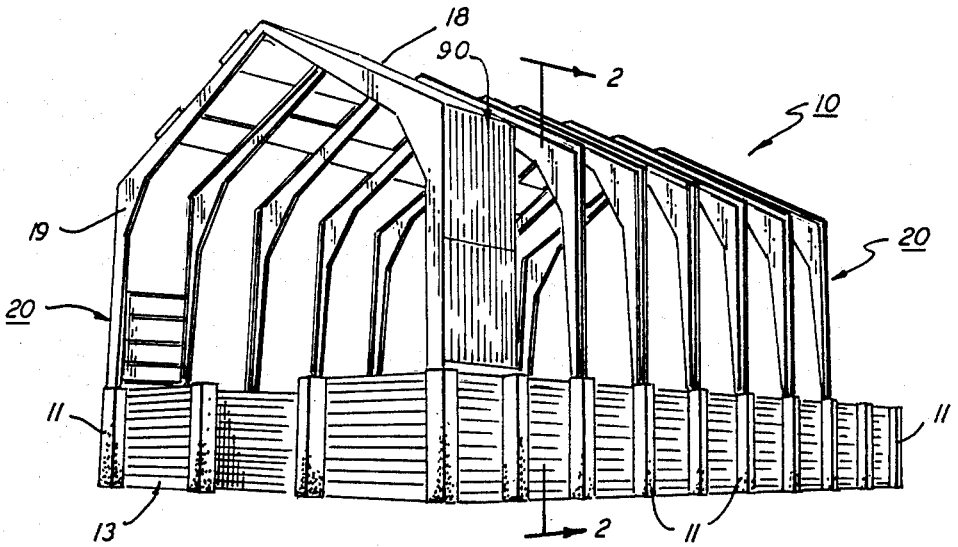
FIG. 1 is a prospective view of a building incorporating truss members embodying the teachings of the present invention.
Figure 2:
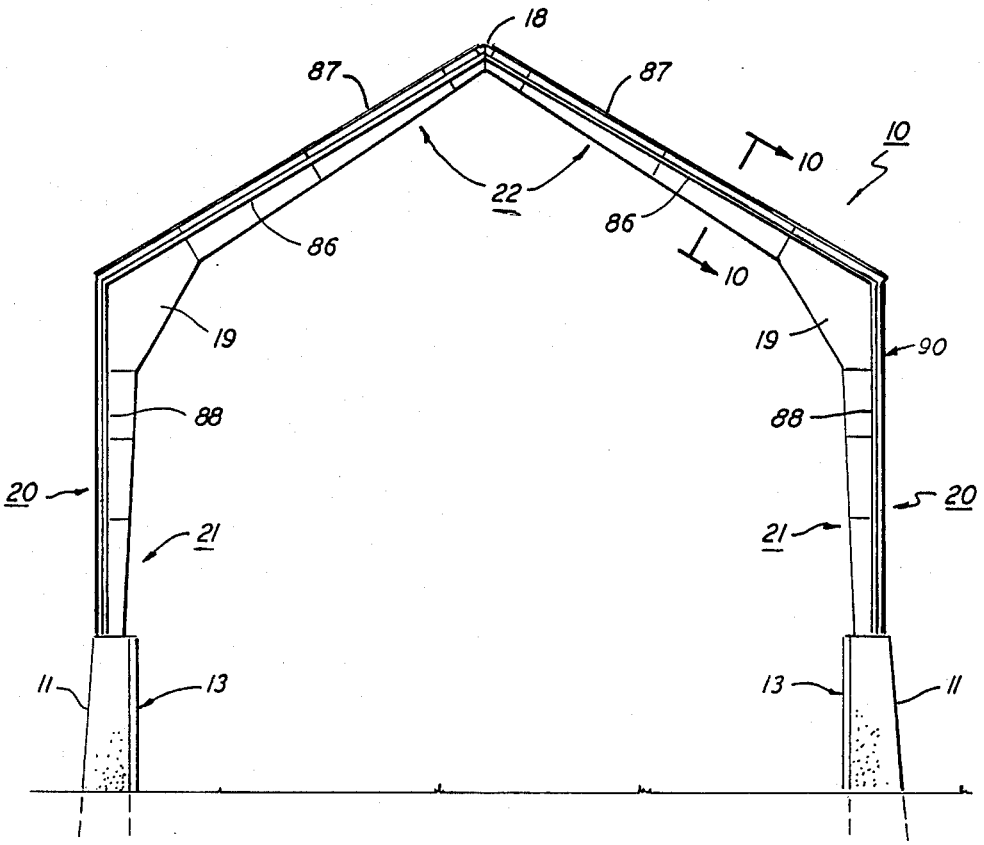
FIG. 2 is an enlarged end view of the building shown in FIG. 1 further illustrating the truss member of the present invention.

Referring now to the drawings, there is shown in FIGS. 1–3 a partially erected building 10 containing a truss assembly embodying the teachings of the present invention. The building is specifically designed to store particulate material, such as salt or sand of the type generally spread over icy road surfaces during the winter months to melt the ice and thus reduce driving risks. It should become apparent from the description below that the building, however, may be used for other purposes. The building includes a series of spaced apart raised concrete pilasters 11—11 that are poured into cored holes formed in the ground. In this embodiment of the invention the pilasters are erected in a rectangular pattern which defines the perimeter of the building. The top surface of the pilasters are all raised to the same elevation so that they lie in a common plane. A barrier wall 13 is placed inside the pilasters and is raised from ground level to the same elevation as the pilasters. The wall is formed of pressure treated beams 15—15 that are stacked one upon the other as illustrated in FIG. 3. A tongue and groove joint 12 is furnished between the abutting beams to strengthen the wall. Galvanized metal inserts 16—16 having dovetails that are anchored in each of the pilasters and are arranged to pass through the joints between adjacent timbers. The terminal end of each insert is bent into parallel alignment with the inner face of the wall and is nailed to a timber to hold the wall in place and provide additional strength.

The wooden beams forming the barrier wall may be replaced with beams made of concrete or any other similar construction that have a high enough strength to protect the pilasters from equipment that might be operating in the building. In addition, the beams should also be able to withstand deterioration when materials such as salt or wet sand is piled thereagainst. To this end, the wooden beams are pressure treated to prevent the wood from rotting when contacted by salt and/or water.

A roof truss member designated 20 is seated in an upright position upon each of the raised concrete pilasters in the side rows. Each truss member includes a vertically disposed column section 21 and an upwardly pitched roof beam section 22 which, as will be explained in greater detail below, is connected to the top of the column section to form a knee joint like corner depicted generally at 19 (FIG. 2). The pilasters are arranged as shown in FIGS. 1 and 2 in spaced alignment along the opposing side walls of the building. The truss members mounted upon opposing side wall pilasters are arranged to come together in abutting contact at their crowns with the crowns describing the peak 18 of the roof. As can be readily seen in FIG. 1, the present construction eliminates the need for horizontal beams, purlin joists, or the like that are typically employed in more conventional structures for joining the truss members in assembly. The entire area inside the building is thus free from the floor level to the roof level of any structural element that might impede the maneuvering of heavy or bulky equipment operating inside the building.

Although not shown, an enlarged doorway is formed in either the front or rear wall of the building so that heavy equipment can conveniently enter and leave the building. Where the building is used to store road salt or sand, a dump truck or the like can enter the building through the enlarged door opening, raise the dump body to discharge its load, and without fear of encountering any structural members, exit the building with the dump body still in an elevated or partially elevated position. Accordingly, the need for fixed conveyors and special material handling equipment is eliminated. The danger of a truck or the like striking a structural building element as it is being maneuvered inside the building is also greatly reduced, and the loading and unloading can be carried out rapidly and efficiently.

As illustrated in FIG. 3, the column section of each truss member is securely anchored by anchor bolts to the top of a supporting pilaster by means of opposing angle plates 24 and 25. The raised arms f the plates are connected to the base of the column section by means of through bolts 26. A series of J-shaped anchor bolts 28 are cast into the top section of the pilaster as shown. The raised portion of each bolt is arranged to pass through an enlarged hole (not shown) formed in the base legs of the angle plates, and a nut 27 is threaded onto the bolt and tightened against the base leg thus securing the truss member in an upright position.

Each of the two sections making up the truss member contains a hollow box-like frame that is assembled as by gluing together standard size pieces of lumber. These pieces of lumber can be either 2×4 members or 2×8 members which are cut to any desired length. The side walls of the frames are closed in final assembly by means of plywood cover panels 65—65. The two sections of the truss are prefabricated under closely controlled tolerances at the factory and are shipped to the building site for final assembly. All joints between the various wooden components are accurately cut and closed at the factory using suitable high strength bonding material. As a result, each truss section leaving the factory, although made of wood, represents a unitized structure capable of withstanding extremely high external loads.

Turning now to FIG. 4, there is shown a frame assembly 30 of the column section 21. As noted, all frame members are cut from standard size pieces of lumber having the same cross sectional dimensions. The frame includes a vertically disposed outer chord 31 which consists of two studs glued in face-to-face contact along their respective lengths. The studs are mounted edgewise in the frame with the chord forming the outside wall 32 of the column.

Figures 6, 7, 8, 10, 11:
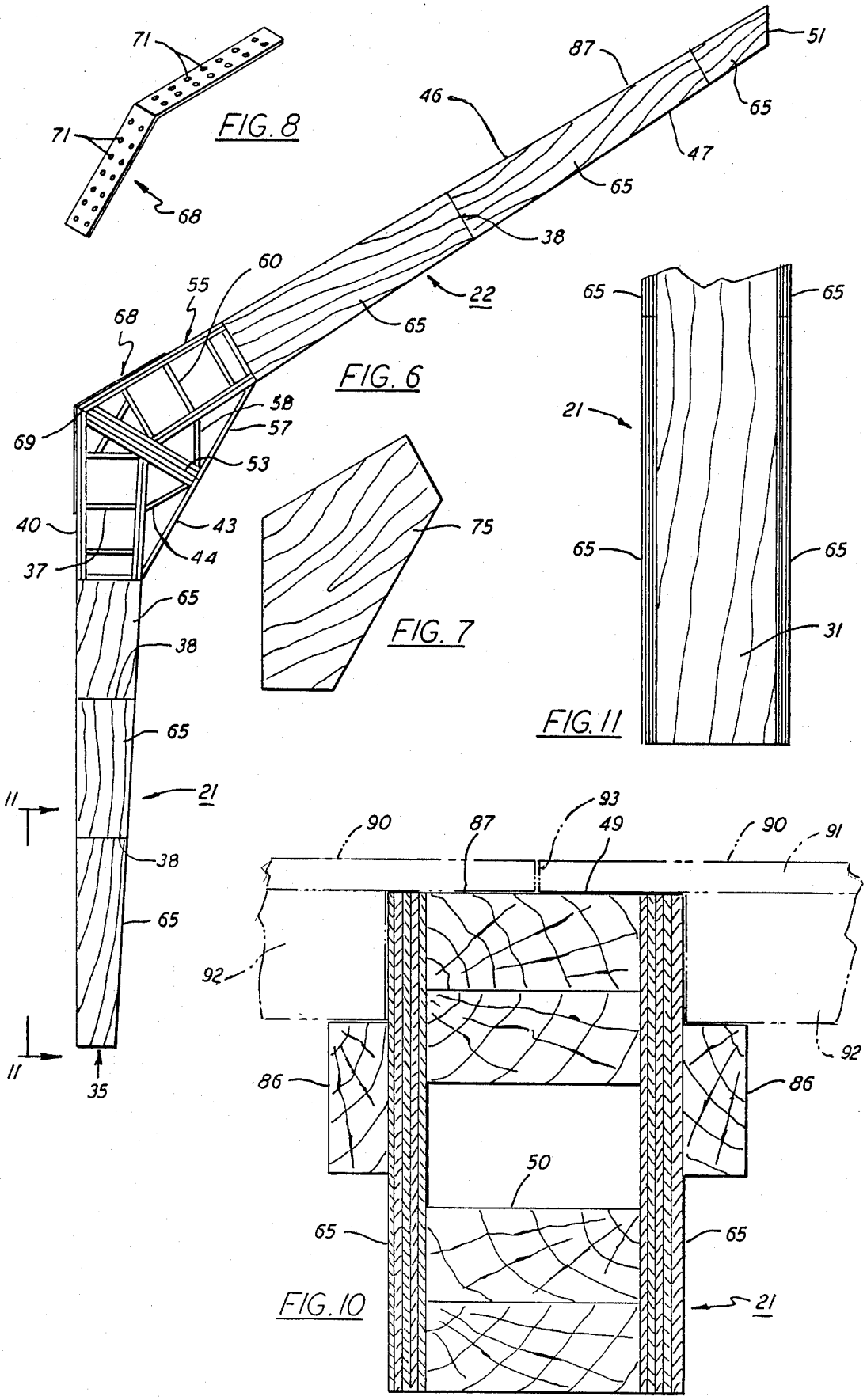
FIG. 6 is a side elevation showing the two sections of the truss member assembled and the sections partially covered with plywood sheeting.
FIG. 7 is a side elevation of a corner panel used to cover the corner section of the roof truss shown in FIG. 6.
FIG. 8 illustrates a corner strap that is placed over the outside edge of the truss corner as shown in FIG. 6.
FIG. 10 is an enlarged section taken along lines 10—10 in FIG. 2.
FIG. 11 is an enlarged end view taken along lines 11—11 in FIG. 6.

The inside wall of the column is similarly formed by inner chord 33 made up of two studs glued in face-to-face relationship. The inner chord which forms the inside wall 34 of the column, is spaced apart from the outer chord and is set at an angle so that the width of the column increases uniformly from the base 35 of the column toward the top of the column. The base of the column is a thick wooden plate generally referenced 35 that is made up of a series of wooden blocks that are glued together in a stacked configuration. The plate is perpendicularly aligned in regard to the vertically disposed inner chord. The plate is thick enough so that the through bolts 26 holding the column to the anchoring angle irons will pass therethrough. A series of horizontally disposed internal ribs 37—37 are mounted between the two chords and provide additional strength to the column. The rib thickness is increased in any region where the side wall cover panels will be joined in abutting contact as for example, at joints 38—38 (FIG. 6). These multiple ribbed members shall be referred to herein as "splices" and are depicted in FIG. 4 by the reference number 39. In this case, the splices are formed by gluing three ribs together in face-to-face contact.

The top portion of the column section includes a bottom corner subsection 40 that extends upwardly from a double splice 41 to the top portion of the column. The bottom corner subsection includes an elongated flange 42 that forms the upper wall of the column section. The flange is inclined downwardly from the outer chord and extends inwardly beyond the inner chord of the column. A brace member 43 is secured at one end to the extended portion of the flange and at the other end to the inner chord at a point adjacent to the previously noted double splice 41. A web 44 is connected between the inside corner formed between the brace member and the flange and the inner chord of the column section to provide added rigidity and stiffness to the bottom corner subsection. In this particular construction, the flange member is again fabricated by gluing top studs together in a face-to-face configuration. The brace and web members, however, are fabricated from single studs because of different load bearing considerations.

FIG. 5 shows the frame 48 of the pitched roof beam section of the truss member. Here again, the frame components are accurately cut in the factory to close tolerances and are glued together prior to shipment to provide a unitized high-strength assembly. The roof beam frame 48 includes an outer chord 49 that forms the outside wall 46 of the section and a spaced apart inner chord 50 that forms the inside wall 47 of the section. The inner chord is inclined so that the width of the roof beam section increases uniformly from the upper ends 51 towards its lower end. A vertically disposed crown member 52 consisting of two glued together studs is situated at the terminal end of the beam, the purpose of which will be described in greater detail below.

The roof beam section of the column also includes a top corner subsection 54 that encompasses the lower end of the roof beam section. The top corner subsection 54 includes an elongated flange 56 that extends inwardly at an angle from the upper chord 49 to a point beyond the lower chord. The beam flange 56 is coextensive in length with the column flange member 42. The two flange members are brought together in final assembly to form an elongated corner connection 53 illustrated in FIG. 7. The corner subsection of the roof beam further includes a brace member 57 and a web 58 that are bonded to the roof beam.

As further illustrated in FIG. 5, the inner and outer chords of the roof beam section are extra strength members that are formed by gluing together studs in face-to-face contact. Ribs 60—60 are mounted at intervals between the chords as well as a plurality of triple thickness splices 61—61 in those regions where the side wall sheeting 65—65 (FIG. 6) forms a joint 38. In addition, longitudinal splices 62 and 63 are provided along the inside of the chords behind joints formed along the chords. A double splice 65 is also provided which defines the inner boundary of the top corner subsection 54. In this section, all ribs are mounted perpendicular to the upper chord 49.

The column and beam sections are partially enclosed at the factory by gluing plywood cover panels 65—65 over the two section frames. As noted, all joints between panels occur over a splice so that the end portions of the panels can be securely glued to the frame. The two corner subsections 40 and 54, however, remain uncovered until such time as the two sections are joined together at the erection site. At the time of final assembly, the two elongated flange members 42 and 56 are aligned in abutting contact as shown in FIG. 6 and the flanges are then bolted tightly together to securely attach the roof beam section to the column section. When the two sections are assembled, the brace members 43 and 57 are brought into coplanar alignment to form an elongated bracket that helps to support the angled roof beam upon the column.

The elongated connection 53 (FIG. 6) between the column and the roof beam occurs along a line of maximum moment and therefore the elongated flange members and the brace members and not the bolt carry the entire load in this corner region.

A metal tension plate is connected over the outside of the corner 69 formed between the two sections. The plate is secured in place by nailing, lagging or wood screwing it to the adjacent outer chords of the column and roof sections. Holes 73—73 are provided in the strap in correct quantities and sizes to provide adequate shear connectors for the tension in this member. The tension in this member is determined by span, height, dead load, snow load and wind load and must be calculated to meet existing conditions of the location of the building.

After the column has been joined to the roof section, the two adjacent corner subsections are closed by gluing a corner panel 75 over the corner on either side of the assembled truss member. The grain of the cover panels is arranged so that it runs generally perpendicular to the elongated flange members. The remaining cover panels are arranged so that the grain of the panels run lengthwise along the sections. By so aligning the panels, and securely gluing them to the section frames, the panels serve to unitize the entire structure and provide a maximum amount of strength to the truss.

Prior to hoisting a truss member into place upon a support pilaster, the truss member is attached at the crown to a companion truss as shown in FIG. 9. The opposing crown members are aligned in abutting contact as shown using a single bolt 80 that is passed through the adjacent crown members and locked in place using nut 81. Access ports 82—82 are provided in the adjacent roof beam panels to permit insertion and tightening of the bolts. A crown plate 85 is placed over the crown joint formed by the abutting roof beam sections and is fastened to the sections using screws, nails or the like. The crown plate helps keep the crown joint tightly closed, however, because of the construction of the truss member, it is not required to resist any external loading.

Leger strips 86 (FIG. 10) are bonded to the opposing side walls of the roof beam section a predetermined distance from the top surface 87 of the roof beam section. Similar legers 88—88 (FIG. 2) are also bonded to the opposing side walls of each column section. The legers provide additional strength to the sections and also furnish seats upon which sheeting is attached.

As illustrated in FIG. 10 the sheeting consists of individual units 90—90 that include an elongated sheet 91 of plywood, pressed fiber board or the like. A series of joists 92 are glued to the back of each sheet that are arranged to rest in assembly upon the leger strips carried by adjacent truss members. Adjacent sheets 91—91 are further adapted to pass over the top of the truss members and form a tight joint 93 that extends along the length of the outer chord of the covered section. Again, the joints between the sheeting units and the contacted truss surfaces can be closed by gluing to provide a tight weather resistant closure.

While this invention has been explained with reference to the structure disclosed herein, it is not confined to the details set forth and this application is intended to cover any modifications and changes as may come within the scope of the following claims.

What is claimed is:

1. A wooden truss member that includes a vertically disposed column section and an upwardly and inwardly pitched roof section angularly disposed from the column section to form a corner therebetween, each of said sections including a hollow frame that is enclosed on each side by cover panels, a connecting means at the corner that includes flange means that extend from the outside of said corner beyond the inside of said, corner and a brace means having 2 opposed ends and a mid-region mounted on the inside of the corner, said brace means being at either end to one of the sections and at its mid-region to the extended end of the flange means, a corner panel on either side of said truss member that spans the corner to cover the flange means and the brace means and which is in abutting contact with adjacent cover panels whereby the truss member is completely enclosed by said panels, and means to attach the panels to the frame of each of said sections.

2. The truss member of claim 1 wherein the flange means includes a first flange member attached to the frame of the roof beam section and a second flange member attached to the frame of the column section and means to join the flange member in face to face contact.

3. The truss member of claim 2 wherein the corner panels are placed over the corner with the wood grain of the panel running perpendicular to the flanges, and the remaining cover panels being attached to the frames of the sections so that the grain of said cover panels runs longitudinally along the length of the section.

4. A wooden truss member that includes a vertical column section and an upwardly pitched roof beam section angularly disposed from the top of the column section to form a corner therebetween, each section further including a frame having an outer chord and a spaced apart inner chord forming the end walls thereof and cover panels for enclosing the side of said frames, a connecting means for joining the two sections at the corner that includes a first flange member that is affixed to the roof beam frame and a second flange member that is affixed to the column frame, said flange member extending from the outside of said corner inwardly beyond the inside of said corner, fastening means for joining the two flanges in face-to-face contact, brace means mounted inside the corner between the inner chords of the two sections that is attached to the extended end of the flanges, corner panels on both sides of the truss member abut the adjacent cover panels and enclose the flange members, and the brace member, and means to secure the panel to the frames.

5. The truss member of claim 4 wherein the outer chord of the column section is vertically aligned and the inner chord slants outwardly from the base of the column section toward the corner.

6. The truss member of claim 5 wherein the upper chord of the roof beam section is set at a desired pitch and the inner chord of the section slants outwardly from a crown at the upper end of said section toward the corner whereby the width of the two frames between the chords are equal at the corner.

7. The truss member of claim 4 having internal ribs extending between the chords of each frame to strengthen the frames.

8. The truss member of claim 4 wherein the column section frame further includes a base member of the bottom of the section that is perpendicular to the outer chord.

9. The truss member of claim 8 that further includes anchor means joined to the base for supporting the column in an upright position, said anchor means providing shear and moment resistance for the column when in an upright position.

10. The truss member of claim 4 wherein the panels are plywood sheets, said corner panels being arranged so that the wood grain of said panels runs perpendicular to the flanges and the remaining cover panels are arranged so that the wood grain of the cover panels runs parallel to the length of the sections.

11. The truss member of claim 10 that further includes multiple ribs stacked one upon the other between the chords of each section beneath joints formed between abutting panels.

12. The truss member of claim 4 that further includes ledger strips mounted on the opposing sides of the sections over the enclosing panels, said strips being parallel with the outer chords of the sections and spaced a predetermined distance from the outer surface of said chords to mount wall and roof panels thereon thereby eliminating the need for joist hangers.

13. The truss member of claim 8 wherein the frame of the roof beam section further includes a crown member at the top of said section that is perpendicular with the base member of the column section.

14. The truss member of claim 13 that further includes means for joining the crown member to another crown member that is mounted upon a second truss member.

* * * * *

UNITED STATES PATENT AND TRADEMARK OFFICE

CERTIFICATE OF CORRECTION

PATENT NO. : 4,854,104

DATED : August 8, 1989

INVENTOR(S) : Patrick G. Pomento

It is certified that error appears in the above-identified patent and that said Letters Patent is hereby corrected as shown below:

Col. 7, line 8, after "being", please insert --attached--.

Signed and Sealed this

Twenty-fourth Day of July, 1990

*Attest:*

HARRY F. MANBECK, JR.

*Attesting Officer*

*Commissioner of Patents and Trademarks*